United States Patent [19]

Gates

[11] Patent Number: 4,477,023

[45] Date of Patent: Oct. 16, 1984

[54] HOT SPRAY APPARATUS

[76] Inventor: James T. Gates, 1611 Kirkley Rd., Columbus, Ohio 43221

[21] Appl. No.: 465,515

[22] Filed: Feb. 10, 1983

Related U.S. Application Data

[63] Continuation-in-part of Ser. No. 261,249, May 6, 1981, abandoned.

[51] Int. Cl.[3] ..... B05B 7/30

[52] U.S. Cl. ..... 239/340; 239/353; 239/375

[58] Field of Search ..... 239/310, 318, 314, 337, 239/340, 375, 344, 348, 349, 353, 354; 222/478, 631

[56] References Cited

U.S. PATENT DOCUMENTS

| | | | |
|---|---|---|---|
| 1,843,899 | 2/1932 | Martinet | 239/348 |
| 2,264,312 | 12/1941 | Hothersall | 239/375 X |
| 2,744,791 | 5/1956 | Budwig | 239/340 X |
| 2,926,857 | 3/1960 | Snyder | 239/353 |
| 3,044,713 | 7/1962 | Ellis | 239/346 |
| 3,191,869 | 6/1965 | Gilmour | 239/348 X |
| 3,780,951 | 12/1973 | Powers | 239/333 |
| 4,023,524 | 5/1977 | Goldfarb et al. | 239/346 X |

FOREIGN PATENT DOCUMENTS 1272279 4/1972 United Kingdom .

*Primary Examiner*—John J. Love
*Assistant Examiner*—Mary McCarthy
*Attorney, Agent, or Firm*—Sidney W. Millard

[57] ABSTRACT

A special container vessel and associated compatible spray for dispensing hot liquids in spray form such as melted butter, margarine, peanut oil, and the like; more specifically, for spraying popcorn uniformly.

10 Claims, 3 Drawing Figures

HOT SPRAY APPARATUS

This is a continuation-in-part of application Ser. No. 261,249, filed May 6, 1981, now abandoned.

FIELD OF INVENTION

This invention discloses an apparatus for spraying melted butter or the like over popcorn (or any other desired solid).

BACKGROUND OF THE INVENTION

Pouring melted butter or the like over popcorn leaves only a portion of the kernels buttered and some with too much butter. Whether popcorn is processed in oil, or in the dry uncooked kernel state, as recommended in microwave ovens by some manufacturers, butter is generally added after the kernels are popped. Some popcorn cookers have a perforated drip butter pan that can be used to butter popcorn after popping, but this method dispenses butter only on the top layer of the popcorn and not uniformly. No method of hot butter dispensing works as well as my invention and none like it is yet available on the market. Common polyethelene spray dispensers are not suitable for spraying hot liquids in the temperature range of hot butter, margarine, oils, and the like. Also, it should be noted that conventional spray apparatus as is used for spraying water on clothes to be ironed or on plants will not spray butter because of its viscosity. Moreover, it is not practical to spray butter through valves, springs, and other mechanisms. But, even if such were possible, cleaning would be difficult and unsanitary.

SUMMARY OF THE INVENTION

The novel arrangement of the instant invention employs a wide mouth heat resistant vessel suitable for containing hot oils (liquid butter, peanut oil, margarine, or the like) and an associated spray dispenser of heat resistant materials compatible with same. The entire design of the invention is aimed at providing safety of use and convenience of applying melted butter, or the like, on popcorn specifically, but can be used to spray other vegetables, such as potatoes, broccoli, and other eatables. Just great for buttering pancakes! The product can be used for basting or spraying cooking utensils. The product can also be used to spray light viscosity salad dressings. A number of approaches have been developed to eliminate the problems found in conventional sprayers. In my invention the butter does not come in contact with moving parts, but is aspirated out of the vessel containing the liquid butter, margarine, or such. It is interesting to note that butter or margarine after being melted (melting point 130° F.) does not solidify for about two hours at room temperature in the container of the invention.

To meet this aim, a number of objectives are claimed as follows: An objective of the present invention is to provide a heat resistant, wide mouth vessel for ease of pouring therein hot oil, melted butter, or margarine. Hot fluid can be poured into the vessel without melting or cracking the same.

Another objective of the invention is to provide a heat resistant vessel to contain one-quarter pound of butter, or margarine in solid form (when melted, approximately four liquid ounces).

Another objective is to include gradation markings on the vessel of 1, 2, 3, and 4 indicating portions of a stick (¼ pound) of butter, or margarine, that is in the container.

Another important feature of the invention is to provide a rigid heat resistant suction tube (preferably stainless steel, nylon, or polycarbonate) as part of the spray pump device and an assembly attachment to fix the tube within said vessel, such that it will not melt or bend.

A further objective is to provide a large diameter heat resistant lid for the heat resistant vessel—a feature not found in ordinary spray pumps.

Another objective is to provide a container in which excess butter can be stored in a refrigerator and later melted in the same container by placing the container in boiling water, microwave oven, or the like.

Another objective is providing a spray pump of heat resistant polymer (one that will withstand boiling water) that is compatible with eatable food and which can be cleaned easily.

Finally, and most important, to provide an air pump section that will provide air dispensing at the proper pressure and velocity to aspirate the viscous liquid out of the container.

Other objectives, advantages, and novel features of the present invention will become apparent from the following detailed description of the invention when considered in conjunction with the accompanying drawings.

DESCRIPTION OF THE PREFERRED EMBODIMENT

Figure 2:
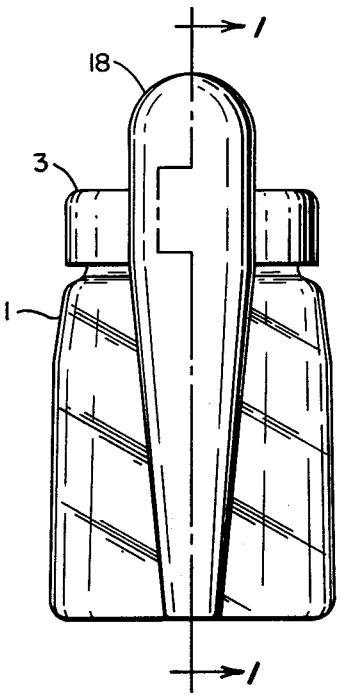
FIG. 2 is a side elevational view of FIG. 1.
Figure 1:
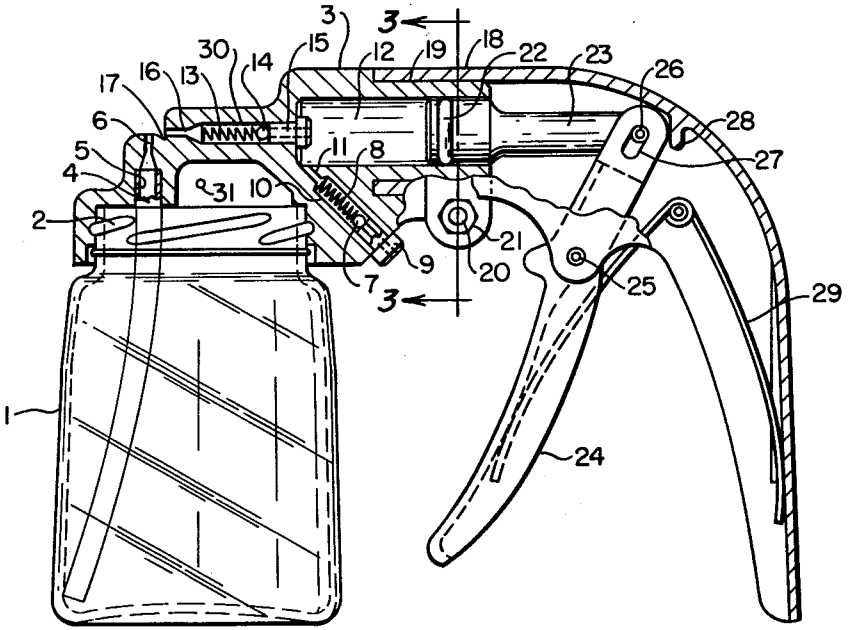
FIG. 1 is a sectional elevational view of the hot liquid container and the separate air pump device attached to the container as viewed in the direction of the arrows 1—1 of FIG. 2.

Referring now to the drawings, wherein like reference numerals designate identical or corresponding parts throughout the several views. FIG. 1 shows a sectional view of the spray dispenser assembly in which 1 is the high temperature (to 300° F.) heat resistant translucent vessel (preferably boron silicate glass or polycarbonate) into which normally hot liquid butter, margarine, or oil is poured or stored. Volume indicia (1, 2, 3, and 4) are integrally molded in the sidewall indicating portions of a ¼ pound stick of butter. The vessel has a wide mouth opening at the top such that a solid ¼ pound of butter can be inserted. Suitable threads 2 for receiving a cap aspirator section 3 circumscribe the mouth of the vessel. This section 3 contains a number of integral and assembled components. The rigid suction tube 4 of about ⅛ inch inside diameter is tightly press fitted into the tapered receptacle hole or cylindrical opening 5, an integral part of section 3. This tapered hole merges into a smaller hole 6 (of about 1/32 inch diameter) where the hot liquid is aspirated.

The cap subassembly has an air intake ball valve or one way valve 7 compressed by a spring 8 against press fitted open tubular valve retainer 9. These three components 7, 8, and 9 make up the valve assembly, which is contained in the hole opening 10 (of about 3/16 inch diameter) of section 3. A smaller hole 11 leads from the inner end of hole 10 into a section cylinder 12 (of about ½ to ⅝ inch diameter). A similar air flow restriction valve is located in a cylindrical aperture 30 at the outlet end of air cylinder 12, and houses compression spring 13, ball valve 14, and press fitted adapter 15. The entire assembly terminates in a small tapered hole 16 of about 0.025 inches diameter.

Hot liquid butter, margarine, and the like are sucked up suction tube 4 and drawn from hole 6 by action of high velocity air from air cylinder 12 emitted through orifice hole opening 16. The air stream coming out of orifice hole 16 is deflected upward by a slight inclined plane 17 thereby improving the suction action of liquid out of container 1 through orifice 6. It is intended that the center line of outlet duct 16 be perpendicular to the center line of cylindrical duct 6 and the center line of duct 16 is also coextensive with the upper planar surface (unnumbered) which is the upper terminus of cylindrical duct 6. The purpose is to have aspiration of melted butter from cylindrical duct 6 and also a certain amount of turbulence for better dispersion of the butter droplets. Thus, the spacing of the terminus of cylindrical duct 16 from the center line is critical and it is about 0.080–0.100 inches.

Ball valve 14 and spring 13 provide an important feature of the invention in allowing cylinder 12 to be built up with air pressure before it is released through valve 14, such that air is emitted in cascade manner by the valve, thus releasing the air stream in increased velocity and out of orifice 16.

Figure 3:
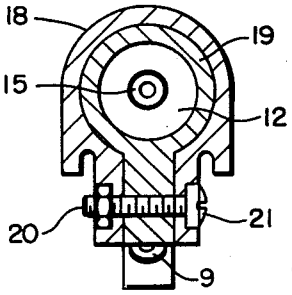
FIG. 3 is a sectional view, taken in the direction of the arrows 3—3 of FIG. 1, showing the attachment arrangement of the two main sections attached to the container.

Main spray pump housing 18 is also an assembly of component and integral parts and subassemblies, as will be described. This pump housing assembly 18 is attached to a cylindrical section 19 of cap aspirator section 3 by means of bolt 20 and nut 21, best observed in FIG. 3. O-ring 22 is fitted to cylindrical piston 23 which reciprocates in cylinder 12 by action of hand lever 24 which is pivoted from the pin 25 attachment to pump housing 18. At the upper end of the hand lever 24 the piston 23 is attached by means of pin 26 through hand lever slot 27. A stop 28, an integral part of molded pump section 18, provides a back position rest for piston 23. Compression wire spring 29 holds the piston-lever assembly in the back position. Reciprocal in-out action of piston 23, by means of attached hand lever 24, sucks air in through spring loaded ball valve 7 and forces air out through spring loaded ball air check valve 14. High velocity air being forced out orifice 16 across orifice 6 creates a suction of liquid, by vacuum action, up through suction tube 4. The dimensions of the various air and liquid ducts and the previously stated diameter of the cylinder 12 dictate that the stroke of piston 23 be about 1⅛ inches for best effectiveness. A small air bleed hole 31 in cap section 3 allows air into the butter container 1 so that air pressure above the liquid in container 1 remains at one atmosphere pressure.

As the liquid butter, or other substance, is emitted from orifice 6 it is sprayed into fine particles by the high velocity air from orifice 16. Butter or margarine may be first melted and poured into the container or it may be put in the container in solid form and melted in a microwave oven or by other means. Once this substance has been melted, it will stay in this state and remain sprayable for about two hours.

The materials of this invention are critical to their intended function. It has been mentioned previously that container 1 may be immersed in boiling water or inserted into a microwave oven for heating. The container 1 may be taken directly from the refrigerator prior to its heating and its composition must be such that the thermal shock will not crack the walls. It is also important that the piston and the five other parts, hand grip 18, trigger 24, valve retainers 9 and 15, and cap assembly 3 be formed of a polycarbonator, ABS (a polymer of acrylonitrile, butadiene, and styrene), or other suitable polymer.

Having thus described the invention in its preferred embodiment it will be obvious to those having ordinary skill in the art modifications can be made to the structure without departing from the spirit of the invention. Accordingly, it is not intended that the language used herein to describe the invention be limiting upon the invention. Rather it is intended that the invention be limited only by the scope of the appended claims.

I claim:

1. Apparatus for spraying liquid butter or the like onto food comprising, a container with an upper opening for holding the liquid butter, a cap attached in liquid tight engagement to the upper opening of the container, a hole through the cap communicating with the atmosphere and the inside of the container to allow the entrance of air upon the extraction of liquid from the container through the cap, a suction tube extending from the cap to near the bottom of the container, the upper end of the tube being connected in fluid tight engagement with the cap within a cylindrical opening, a cylindrical duct of about 1/32 inch diameter leading from the cylindrical opening through the cap to the atmosphere, the cap including a cylinder containing a reciprocable piston which closes one end of the cylinder, the other end of the cylinder terminating in a check valve, the check valve communicating with an outlet duct of about 0.025 inches diameter and extending perpendicular to the cylindrical duct, the terminus of the outlet being about 0.080–0.100 inches from the center line of the cylindrical duct and the surface of the cap extending at an angle from immediately below the terminus of the outlet duct upwardly to the center line of the outlet duct, the angular surface of the cap terminating before reaching the cylindrical duct, a one way valve being disposed in an opening leading from the atmosphere to the cylinder, a spring biased pivotable trigger connected to the end of the piston outside the cylinder to reciprocate said piston from a rest position where it is most remote from the check valve to an end position where it is adjacent the check valve.

2. The apparatus of claim 1 wherein the container is of boron silicate glass.

3. The apparatus of claim 2 wherein the cap and trigger are of polycarbonate.

4. The apparatus of claim 2 wherein the cap and trigger are of a copolymer of acrylonitrile, butadiene, and styrene.

5. The apparatus of claim 1 wherein the stroke of the piston from said rest to adjacent positions is about 1⅛ inches.

6. The apparatus of claim 5 wherein the trigger is mounted by a pivot, which pivot is in fixed position with respect to said cap, one end of said trigger includes an elongated slot, the piston includes a pin extending therethrough and perpendicular to its axis, said pin extending through said slot in the trigger to serve to connect the two together for reciprocal movement.

7. The apparatus of claim 5 wherein the container is of boron silicate glass.

8. The apparatus of claim 5 wherein the cap and trigger are of polycarbonate.

9. The apparatus of claim 1 wherein the trigger is mounted by a pivot, which pivot is in fixed position with respect to said cap, one end of said trigger includes an elongated slot, the piston includes a pin extending therethrough and perpendicular to its axis, said pin extending through said slot in the trigger to serve to connect the two together for reciprocal movement.

10. The apparatus of claim 1 wherein the container is of polycarbonate.

* * * * *